United States Patent [19]

Hoover

[11] Patent Number: 4,941,163

[45] Date of Patent: Jul. 10, 1990

[54] MULTISPECTRAL GLANCING INCIDENCE X-RAY TELESCOPE

[75] Inventor: Richard B. Hoover, Huntsville, Ala.

[73] Assignee: The United States of America as represented by the Administrator of the National Aeronautics and Space Administration, Washington, D.C.

[21] Appl. No.: 765,979

[22] Filed: Aug. 15, 1985

[51] Int. Cl.[5] ..... G21K 7/00

[52] U.S. Cl. ..... 378/43; 378/84

[58] Field of Search ..... 378/43, 84, 85; 350/504, 630, 619

[56] References Cited

U.S. PATENT DOCUMENTS

| | | | |
|---|---|---|---|
| 3,821,556 | 6/1974 | Hoover | 378/43 |
| 4,525,853 | 6/1985 | Keem et al. | 378/84 |
| 4,562,583 | 12/1985 | Hoover et al. | 378/43 |

*Primary Examiner*—Craig E. Church

*Attorney, Agent, or Firm*—William J. Sheehan; John R. Manning; Jerry L. Seemann

[57] ABSTRACT

A multispectral glancing incidence X-ray telescope is illustrated capable of broadband, high-resolution imaging of solar and stellar X-ray and extreme ultraviolet radiation sources which includes a primary optical system preferably of the Wolter I type having a primary mirror system (20, 22). The primary optical system further includes an optical axis (24) having a primary focus (F1) at which the incoming radiation is focused by the primary mirrors. A plurality of ellipsoidal mirrors (30*a*, 30*b*, 30*c*and 30*d*) are carried at an inclination to the optical axis behind the primary focus (F1). A rotating carrier (32) is provided on which the ellipsoidal mirrors are carried so that a desired one of the ellipsoidal mirrors may be selectively positioned in front of the incoming radiation beam (26). In the preferred embodiment, each of the ellipsoidal mirrors has an identical concave surface carrying a layered synthetic microstructure coating tailored to reflect a desired wavelength of 1.5 Å or longer. Each of the identical ellipsoidal mirrors has a second focus (F2) at which a detector (16) is carried. Thus the different wavelength image is focused upon the detector irregardless of which mirror is positioned in front of the radiation beam. In this manner, a plurality of low wavelengths in a wavelength band generally less than 30 angstroms can be imaged with a high resolution.

11 Claims, 3 Drawing Sheets

MULTISPECTRAL GLANCING INCIDENCE X-RAY TELESCOPE

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

The general purpose of this invention is to improve the spatial and spectral resolution performance characteristics of glancing incidence X-ray telescope systems capable of broadband, high-resolution imaging of solar and stellar X-ray and XUV (extreme ultraviolet radiation) sources. For certain applications, such as with very high resolution X-ray detectors coupled to extremely high spatial resolution primary mirror systems, very large magnifications may be of great value. Super high-resolution imaging with the most advanced X-ray telescope systems currently being planned for launch in the 1990's on NASA's space station program indicate the desire for coupling systems capable of providing very high magnifications to the initial image; possibly even as high as 10× to 40×.

Instruments such as the Advanced X-ray Astrophysical Facility (AXAF) are designed with the greatest emphasis upon the harder rather than the softer components of the X-ray spectrum. The requirements of high magnification, coupled with the short distance typically afforded by instrument envelope constraints, essentially rule out the possibility of the utilization of large magnification glancing incidence hyperboloid/ellipsoid X-ray microscope optics such as are currently being developed as a part of the NASA Extended Range X-ray Telescope Program.

Furthermore, systems such as have been disclosed in applicant's copending application Ser. No. 571,613, filed on Jan. 17, 1984, entitled SPECTRAL SLICING X-RAY TELESCOPE WITH VARIABLE MAGNIFICATION are not ideally suitable for this application, as normal incidence LSM (layered synthetic microstructure) optics cannot be utilized at wavelengths significantly below 30 angstroms or so.

In the prior art, the Wolter X-ray telescope system is typically used to focus the X-rays from a point source (or an extended source) at infinity to a high-resolution image on the sensitive surface of the detector situated at the prime focus of the Wolter system. For soft X-rays (wavelengths ranging from 2Å to 100Å) the Wolter type I mirror system with coaxial and confocal, concave paraboloidal and hyperboloidal elements (both of which are internally reflecting) is typically used. Such telescopes were flown on the Skylab space station and have been used on the Einstein and Copernicus observatories in space.

High-resolution imagery has been achieved by use of high-resolution detectors, such as photographic emulsions directly in the prime focus of the Wolter X-ray telescope; or with a high-resolution solid state detector placed in the focal plane of a long focal length telescope. Photographic emulsions limit the spectral coverage of X-ray telescopes due to the absorption of soft X-ray and XUV radiation in the gelatin and, consequently, these detectors have relatively low effective quantum efficiencies. The solid state detectors limit the performance, from a spatial resolution point of view, due to the large size of the image elements.

Techniques for coupling Wolter telescopes to solid state detectors by means of convex hyperboloid mirror systems have been described in the above referenced copending application of applicants entitled SPECTRAL SLICING X-RAY TELESCOPE WITH VARIABLE MAGNIFICATION.

The primary disadvantages of utilizing the telescope directly with the detector is that the full resolution capabilities of the primary X-ray mirror system are not utilized.

Furthermore, these methods provide little or no spectral information. Thin metal foils have been mounted on a rotating filter wheel to obtain crude filtergrams of solar X-ray emissions. Due to the nature of these filters, the bandpass is of necessity very broad, which is a great detriment to detailed analysis and plasma diagnostics. Higher spectral resolution can be achieved by means of an objective grating placed immediately behind the Wolter telescope optics. However, for a multipurpose instrument, great care must be taken to ensure that the grating can always be removed from the optical path and that failsafe mechanisms are employed. However, the concave ellipsoidal LSM optics that constitute the novel components of this disclosure can intercept all of the divergent beams from a complex nested system. These optics are easy to construct, even if it is desirable for the magnification to be in the range of 20× to 50×, which we believe will be desirable for certain high-resolution applications.

Accordingly, an important object of the present invention is to provide a glancing incidence X-ray telescope system capable of broadband, high-resolution imaging of solar and stellar X-ray and extreme ultraviolet radiation sources.

Another important object of the present invention is to provide an X-ray telescope system which can be utilized over a broad band of X-ray and extreme ultraviolet radiation sources in the range of thirty angstroms and below.

SUMMARY OF THE INVENTION

The above objectives are accomplished according to the present invention by configuring an optical system utilizing off-axis ellipsoids, operating at angles of incidence that are less than 45 degrees. It should be pointed out that glancing angles such as are usually used in Wolter systems are not required for the LSM optics; however, small angles may be chosen for particular applications. The ellipsoidal LSM optic is placed behind the primary focus of the primary mirror system and utilizes concave optics, rather than the convex mirrors such as have been described in the above referenced application for Letters Patent entitled SPECTRAL SLICING X-RAY TELESCOPE WITH VARIABLE MAGNIFICATION. The primary mirrors focus the X-rays to the first focus of the ellipsoidal LSM, and the high-resolution detector is situated at the other focus of this LSM optic. In the preferred embodiment, a plurality of ellipsoidal mirrors are mounted on a carrier wheel which is utilized to insert a desired LSM mirror into the diverging beam. This allows both the magnification as well as the particular spectral slice of the beam selected to be altered in accordance with the techniques and methods previously described. In other embodiments, for soft X-ray/XUV applications, the ellipsoids are configured to operate near normal incidence, even though their surfaces still remain as concave ellipsoids. There also exist embodiments in which it is desirable to employ more than one LSM optic to render the beam in the most desirable configuration and these systems shall also be described.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
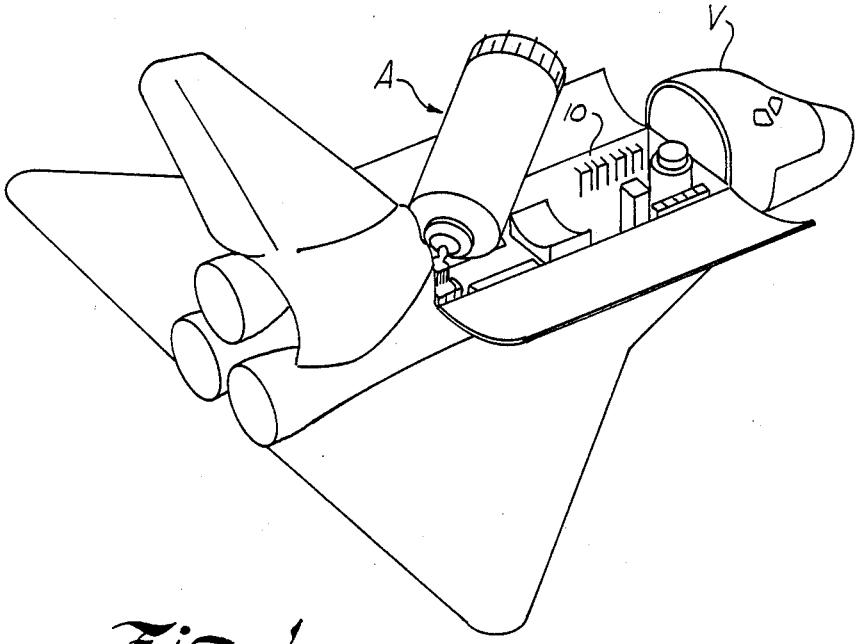
FIG. 1 is a perspective view illustrating an orbiting space shuttle vehicle with the bay open to aim an X-ray telescope constructed in accordance with the present invention.

The invention relates to a broadband, high-resolution, multispectral, glancing incidence X-ray telescope referred to as a Wolter/Gregorian X-ray telescope. The telescope is capable of broadband, high-resolution imaging of solar and stellar X-ray, and extreme ultraviolet radiation sources at wavelengths significantly below 30 angstroms. The telescope has particular applications to missions in space. FIG. 1 illustrates the telescope, designated generally at A, as aimed from the payload bay 10 of an orbiting space shuttle vehicle V. The telescope may also be used in an orbiting observatory as utilized in the high-energy astronomy observatory launched by the United States National Aeronautics and Space Administration (NASA).

Referring now in more detail to the drawings, the multispectral telescope A is illustrated which utilizes concave ellipsoidal layered synthetic microstructure (LSM) mirrors to achieve image magnification and spectral discrimination. The optical system is designed such that the first focus F1 (FIG. 2) of an ellipse 14 lies at the prime focus of a conventional glancing incidence Wolter I or Wolter/Schwarzschild X-ray telescope system 21. An X-ray detector 16 is located at the second focus F2 of the ellipsoid. Concave ellipsoidal mirror 18 is a segment of ellipsoid 14, with corresponding foci F1 and F2. A typical Wolter type I optical system includes a mirror 20 which is a paraboloidal element and a mirror 22 which is a coaxial and confocal hyperboloidal mirror element. X-rays strike these mirrors at less than their critical angle and are effectively reflected to produce an image in the focal plane of the mirror system which is also designated as F1.

Figure 2:
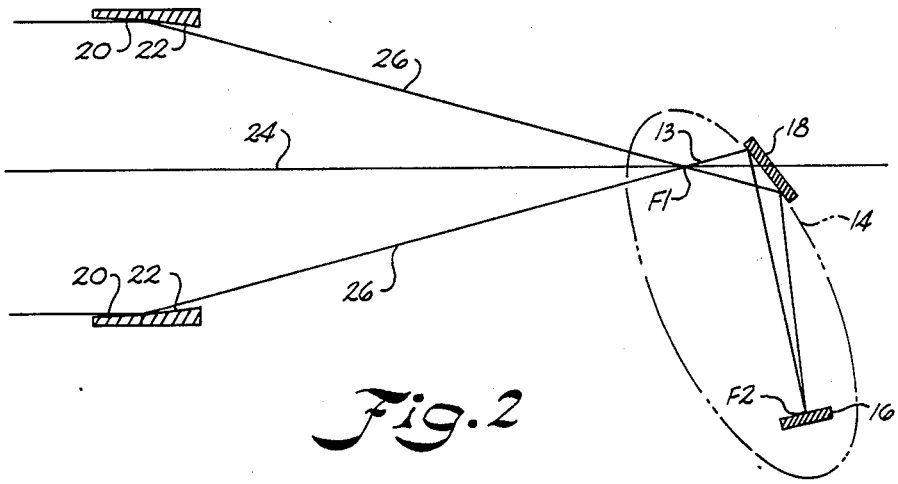
FIG. 2 is a schematic view of a Wolter/Gregorian X-ray telescope constructed in accordance with the present invention.

Referring now to FIG. 2, mirror element 18 is a concave, inclined, ellipsoidal element. The ellipsoidal element is configured such that one of its foci coincides with the prime focus F1 of the Wolter mirror system. A high-resolution X-ray detector such as a charge coupled device (CCD), a ranicon, a multi-annode microchannel array, or a camera carrying X-ray-sensitive photographic film is situated at the focus F2 constituting the detector 16. Since the X-rays strike the inclined LSM ellipsoidal mirror 18 at less than normal incidence, it is possible to reflect X-rays with this mirror of shorter wavelengths than are possible with normal incidence LSM systems. Inclinations of 45 degrees or less are preferred.

Figure 3:
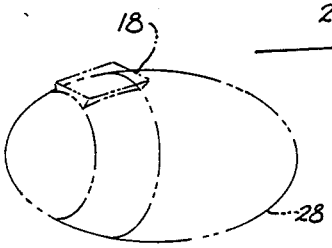
FIGS. 3 and 3*a* are schematic illustrations of concave ellipsoidal LSM optical elements.
Figure 3A:
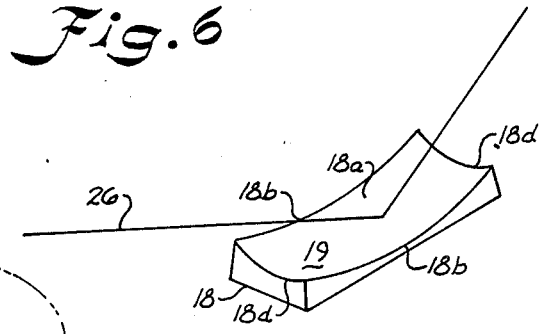

Referring now to FIG. 3*a*, the ellipsoidal mirror 18 is provided with a layered synthetic microstructure coating 19 deposited on the concave surface 18*a* of the mirror. FIG. 3 shows the ellipsoid of revolution 28 which determines the surface contour as ellipsoidal mirror 18 employed in the instant invention. The ellipsoidal mirror 18 includes long sides 18*b* and corresponding ends 18*d*.

The layered synthetic microstructure coating deposited on the mirror is constituted of many (100–1000) alternating layer pairs of different materials of precisely controlled thickness. For example, these may be alternating layers of tungsten and carbon, aluminum and gold, magnesium and gold, etc. The exact nature of the coatings and the thickness of the alternating layers determine the particular wavelength that is effectively reflected. The layers are usually very thin, of the order of 7A to 40A. With the current technology, good reflectives (i.e. 10% to 30%) can be achieved with synthetic microstructure mirrors reflecting a beam R at normal incidence over the wavelength range from 30Å to 400Å or more. To some extent, the mirror coating can be tailored to select a desired spectral slice. Hence, in the preferred embodiment of the invention there would be a plurality of ellipsoidal mirrors, each of which is tailored to reflect a different wavelength.

Figure 4:
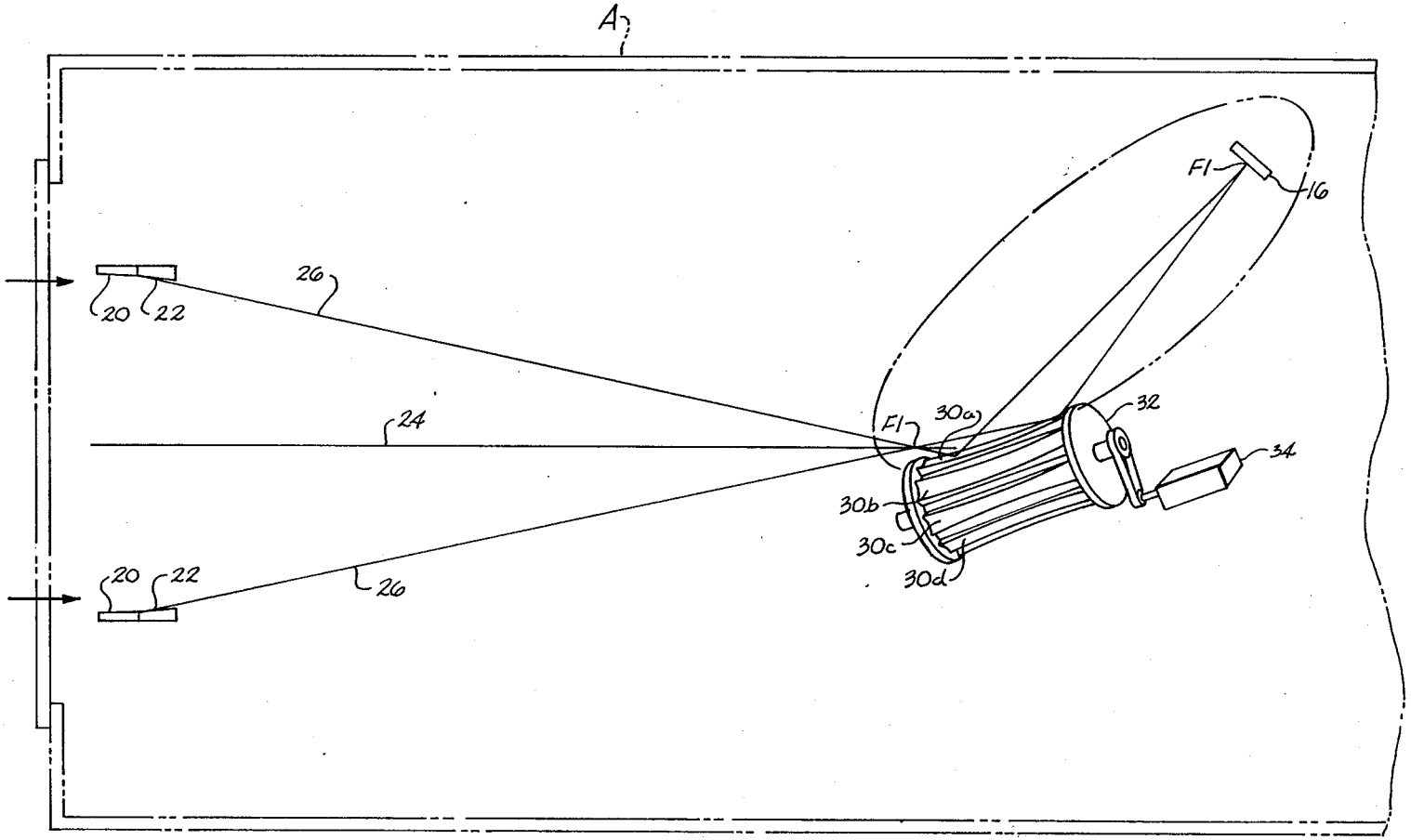
FIG. 4 is a schematic illustration of a multispectral glancing incidence X-ray telescope constructed in accordance with the present invention.

As can best be seen in FIG. 4, a preferred arrangement is provided in which a plurality of inclined concave ellipsoidal mirrors 30*a*, 30*b*, 30*c*, and 30*d* are mounted on a cylindrical carrier 32. The carrier 32 is oriented at a desired angle and positioned with respect to the optical axis 24 of the primary mirror system to present each mirror at a desired inclination to the axis and incoming radiation beam. Each of the mirrors 30*a* through 30*d* is of the same ellipsoidal sections and concave surface such that the primary image focused at F1 is always reimaged onto the image plane of detector 16 at focus F2. The exact LSM coating for each mirror element is changed from one surface to the next, hence each mirror 30*a* through 30*d* will reflect a different X-ray wavelength. A drive motor 34 is provided for rotating the cylinder 32 from a remote location. The drive motor may be a stepper motor, a Geneva mechanism, or other means of accurately positioning each mirror on the rotating cylinder onto the optical axis to allow a shift from one X-ray wavelength to another. While four mirrors are shown, it is to be understood that any number of mirrors may be employed.

Figure 5:
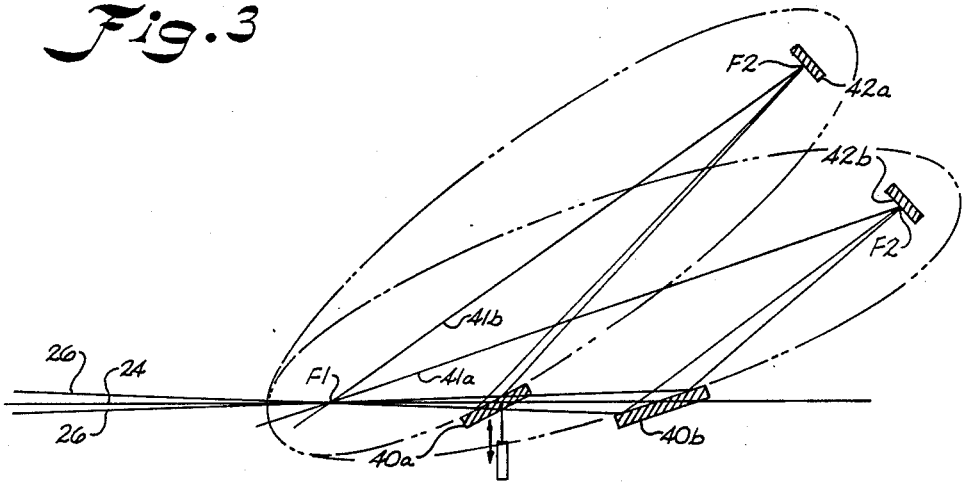
FIG. 5 is an alternate embodiment of a multispectral glancing incidence X-ray telescope constructed in accordance with the present invention.

Referring now to FIG. 5, a method is illustrated in which the inclination axis of the ellipsoid mirror may be chosen to selectively change the angle of the radiation incident upon the mirror elements. LSM ellipsoid mirror elements 40a and 40b are illustrated having inclined axes 41a and 41b, respectively. In this embodiment, the mirrors focus the radiation from the same primary beam 26 to separate detectors 42a and 42b. In practice, mirror 40a may be removed from the primary beam whereby the beam strikes the mirror element 40b and is recorded on the detector 42b. Any suitable mechanism for retracting or removing the forward mirror from the beam may be utilized. The recorded image will be significantly lower in magnification than the image provided by mirror 40a. Furthermore, the mirror elements can have different LSM coatings so that they can also image a spectral slice of different X-ray wavelength. This arrangement has many advantages and protects against loss of an entire experiment by a detector failure since a plurality of detectors are utilized. It is also possible to utilize a single detector and to configure the ellipsoid so that both foci are coincident, even though different magnifications are provided. In this case, the shift from one mirror to the other would alter the image size and resolution for a single fixed detector.

Figure 6:
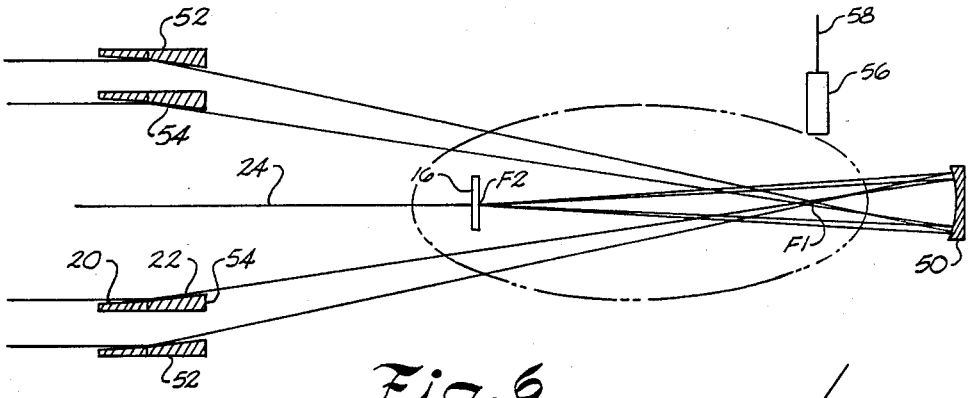
FIG. 6 is another embodiment of a Wolter/Gregorian X-ray telescope constructed in accordance with the present invention.

FIG. 6 represents an alternate embodiment which utilizes a normal incident concave ellipsoidal LSM optical element 50 to reflect the radiation back along the optical axis 24 after striking the element. The detector 16 is located at the second focus F2 of the ellipsoid on the optical axis 24. The radiation is initially reflected by a nested pair of Wolter Type 1 or Wolter/Schwarzschild X-ray mirrors 52 and 54, each comprising a paraboloidal and hyperboloidal element 20 and 22 respectively. This design cannot be utilized with X-rays of wavelengths much shorter than 30 angstroms due to the normal incidence of reflection. However, this embodiment may have advantages in certain ellipsoid configurations. Also, it offers the advantage of allowing the instrument to be considerably shorter and the X-rays are incident upon the LSM optics at uniform angles. In accordance with Bragg diffraction, mirror 50 reflects only one given wavelength of X-rays. However, as described above, several concave ellipsoidal elements may be mounted on a carrier (not shown), or be inserted into the beam by means of remote control to observe different wavelengths and provide variation in magnification and, hence, resolution in field of view of the telescope. A means is illustrated for inserting a detector 56 into the primary beam at the prime focus F1 by means of a movable arm 58. This allows all of the wavelengths reflected by the Wolter optics to be imaged directly, without the spectral slicing and magnification introduced by the LSM optic. This aspect may be of particular value of complementing high spatial and spectral observations with high-sensitivity, broadband studies. This method can be particularly advantageous for sources that are inherently very faint.

Thus it can be seen that by utilization of inclined ellipsoidal elements, it is possible to operate LSM optics at shallower angles and thereby reflect X-rays down to the 1.5 angstrom region or lower. In certain other embodiments, it is possible to easily utilize redundant X-ray detectors to prevent against the loss or failure of an experiment due to detector failure. Normal incidence concave elements can be utilized to achieve superior performance with nested Wolter mirror systems. Alternately, a detector may be placed into a beam prior to the LSM optic for high-sensitivity observations of faint sources over a broad spectral region than is realized with the LSM system.

Most important, however, is the use of concave ellipsoidal optics operating on the diverging beam, after it is passed through the prime focus, allowing harder X-rays to be magnified and imaged than can be achieved with normal incidence LSM convex elements.

While a preferred embodiment of the invention has been described using specific terms, such description is for illustrative purposes only, and it is to be understood that changes and variations may be made without departing from the spirit or scope of the following claims.

What is claimed is:

1. A multispectral X-ray telescope for producing broadband, high-resolution images of solar and steller X-rays and extreme ultraviolet radiation sources comprising:

a telescope housing;

a primary optical system carried within said housing having an optical axis and a primary focus lying on said optical axis, and primary mirror elements carried on a receiving end of said telescope housing for reflecting an incident radiation beam toward said primary focus of said primary optical system;

an X-ray detector carried within said housing;

a plurality of concave ellipsoidal mirrors disposed within said housing behind said primary focus at an inclination to said optical axis upon which said radiation beam is incident;

said ellipsoidal mirrors being arranged in said optical system so that a first focal point of each said ellipsoidal mirror may be positioned to be coincident with the primary focus of said optical system;

said detector being carried at a second focus of said ellipsoidal mirror off of said optical axis;

a layered synthetic microstructure coating carried on each said ellipsoidal mirror to enhance the reflectivity of a desired wavelength of high energy radiation; and positioning means for selectively positioning one of said ellipsoidal mirrors behind said primary focus so that said radiation beam is incident upon said first focal point of said ellipsoidal mirror to thereby reflect X-rays of said desired wavelength upon said detector.

2. The apparatus of claim 1 wherein said ellipsoidal mirrors are elongated and are carried on a rotating carrier having its axis inclined to the optical axis of the optical system.

3. The apparatus of claim 1 wherein said rotating carrier is a cylindrical member and said elongated ellipsoidal mirrors are mounted with their longitudinal axis parallel to the rotational axis of said cylindrical member.

4. The apparatus of claim 1 wherein said ellipsoidal mirrors have concave surfaces of identical curvature so that each of said ellipsoidal mirrors has the same foci and each said mirror images upon said detection.

5. An X-ray telescope for high-resolution imaging of wavelengths in a low wavelength band comprising:

a telescope housing;

a primary optical system having a glancing incidence primary mirror element carried on a receiving end of the telescope housing for reflecting incident radiation beam;

said primary optical system having an optical axis and a primary focus disposed within said housing;

an ellipsoidal mirror having a concave surface disposed behind said primary focus at an inclination to the said optical axis of said primary optical system;

said ellipsoidal mirror having a first focus coincident with the primary focus of said primary optical system;

said ellipsoidal mirror having a second focus lying off of said optical axis;

an X-ray detector carried at said second focus of said ellipsoidal mirror; and a layered synthetic microstructure coating deposited on the concave surface of said ellipsoidal mirror to enhance the reflectivity of a desired wavelength in said low wavelength band.

6. The apparatus of claim 5 including a plurality of said ellipsoidal mirrors each having an identical curvature;

a different layered synthetic microstructure coating carried on each of said ellipsoidal elements to enhance the reflectivity of different wavelengths in said low wavelength band; and means for selectively positioning a desired one of said ellipsoidal mirrors at said inclination to said optical axis of said primary optical system in front of an incident beam of said radiation.

7. A method of imaging X-ray and extreme ultraviolet radiation sources over a broadband of wavelengths generally below 30 angstroms with a high-resolution which comprises the steps of:

providing a glancing incidence primary mirror system for reflecting a radiation beam of said radiation source toward a primary focus of the primary optical system located on an optical axis of said optical system;

arranging an ellipsoidal mirror along said optical axis behind said primary focus at an inclination to said optical axis so that a first focus of said ellipsoidal mirror is coincident with said primary focus of said optical system and a second focus of said ellipsoidal mirror is coincident with said primary focus of said ellipsoidal mirror lies off said optical axis;

arranging an X-ray detector at said second focus of said ellipsoidal mirror;

providing said ellipsoidal mirror in the form of a mirror element having a concave surface with a layered synthetic microstructure coating on said concave surface to reflect a desired wavelength within said broadband of low wavelengths.

8. The method of claim 7 including arranging a plurality of said ellipsoidal mirrors on a carrier at an inclination to said optical axis;

providing a different layered synthetic microstructure coating on each of said ellipsoidal elements whereby each of said ellipsoidal mirrors reflects a different wavelength; and selectively moving a desired one of said ellipsoidal mirrors in front of said radiation beam to provide multiple spectral imaging of said radiation source according to different wavelengths; and forming each of said ellipsoidal mirrors to have an identical concave surface so that said second focus is identical for each of said ellipsoidal mirrors whereby said image reflected by each of said ellipsoidal mirrors falls upon said detector.

9. A method of imaging X-ray and extreme ultraviolet radiation sources with a high-resolution comprising the steps of:

providing a glancing incidence primary mirror system for reflecting a radiation beam of said radiation source toward a principal focus of the primary optical system located on an optical axis of said optical system;

arranging an ellipsoidal mirror at a point on said optical axis behind said primary focus of said optical system so that a first focus of the ellipsoidal mirror is coincident with said primary focus of said optical system;

arranging an X-ray detector at a second focus of said ellipsoidal mirror; and providing a concave surface on said ellipsoidal mirror having a layered synthetic microstructure coating which reflects a desired wavelength.

10. The method of claim 9 comprising:

providing a plurality of said ellipsoidal mirrors;

carrying said ellipsoidal mirrors on a carrier which selectively positions a desired one of said ellipsoidal mirrors behind said primary focus;

providing an identical concave curvature on each of said ellipsoidal mirrors so that each of said ellipsoidal mirrors has a same second focus.

11. The method of claim 9 including mounting said ellipsoidal mirrors at an inclination to said axis so that each of said ellipsoidal mirrors has a second focus at the identical location off of the optical axis.

* * * * *